US007586264B2

(12) United States Patent
Stokes et al.

(10) Patent No.: US 7,586,264 B2
(45) Date of Patent: Sep. 8, 2009

(54) COLLECTOR COOLING ARRANGEMENT

(75) Inventors: Michael John Stokes, Boreham (GB); Stephen William Hurrell, Chelmsford (GB)

(73) Assignee: E2V Technologies (UK) Limited, Chelmsford (GB)

( * ) Notice: Subject to any disclaimer, the term of this patent is extended or adjusted under 35 U.S.C. 154(b) by 603 days.

(21) Appl. No.: 11/489,712

(22) Filed: Jul. 20, 2006

(65) Prior Publication Data

US 2007/0060008 A1 Mar. 15, 2007

(51) Int. Cl.
*H01J 23/033* (2006.01)

(52) U.S. Cl. ..... 315/5.38; 315/5.37; 313/35; 313/36; 313/22

(58) Field of Classification Search ..... 315/5.37, 315/5.38, 5.39, 404; 313/35, 36, 22–24; 165/80.4

See application file for complete search history.

(56) References Cited

U.S. PATENT DOCUMENTS 5,493,178 A 2/1996 Byram et al.
5,705,881 A * 1/1998 Friquet et al. ..... 313/35
6,429,589 B2 * 8/2002 Schult ..... 315/5.37
6,601,641 B1 * 8/2003 Stefanik et al. ..... 165/80.4
6,617,791 B2 * 9/2003 Symons ..... 315/5.38
2005/0062381 A1 * 3/2005 Aitken ..... 315/5.38

FOREIGN PATENT DOCUMENTS

GB 2 387 713 A 10/2003
WO WO 00/63944 10/2000

* cited by examiner

*Primary Examiner*—Douglas W Owens
*Assistant Examiner*—Ephrem Alemu
(74) *Attorney, Agent, or Firm*—Venable LLP; Robert Kinberg

(57) ABSTRACT

A cooling arrangement for an electron collector of an electron beam tube has a plurality of solid dielectric spacers surrounding the corrector with an electrically insulative and thermally conductive dielectric liquid in gaps between the spacers. A water cooling system is arranged in thermal contact with the spacers and the liquid dielectric to provide cooling by water circulation. The cooling arrangement is a hybrid of oil and water cooling systems in which the electrically non conductive oil is arranged in gaps between dielectric spacers, the dielectric spacers provide a support for the surrounding water coolant system and ordinary water may be used to be pumped through the water cooling system.

22 Claims, 4 Drawing Sheets

COLLECTOR COOLING ARRANGEMENT

CROSS-REFERENCE TO RELATED APPLICATIONS

This application claims priority from Application No. GB0514896.0 filed in the United Kingdom on Jul. 20, 2005, the disclosure of which is incorporated herein by reference.

FIELD OF THE INVENTION

The present invention relates to collector arrangements for electron beam tubes.

BACKGROUND OF THE INVENTION

Electron beam tubes are used for the amplification of RF signals and are typically linear beam devices. There are various types of linear electron beam tube known to those skilled in the art, examples of which are the Klystron, and the Inductive Output Tube (IOT) and Travelling Wave Tubes (TWTs). Linear electron beam tubes incorporate an electron gun for the generation of an electron beam of an appropriate power. The electron gun includes a cathode heated to a high temperature so that the application of an electric field between the cathode and an anode results in the emission of electrons. Typically, the anode is held at ground potential and the cathode at a large negative potential of the order of tens of kilovolts.

Inductive Output Tubes used as amplifiers broadly comprise three sections. An electron gun generates an electron beam, which is modulated by application of an input signal. The electron beam then passes into a second section known as the interaction region, which is surrounded by a cavity arrangement including an output cavity arrangement from which the amplified signal is extracted. The third stage is a collector, which collects the spent electron beam.

In an inductive output tube (IOT) a grid is placed close to and in front of the cathode, and the RF signal to be amplified is applied between the cathode and the grid so that the electron beam generated in the gun is density modulated. The density modulated electron beam is directed through an RF interaction region, which includes one or more resonant cavities, including an output cavity arrangement. The beam may be focused by a magnetic means to ensure that it passes through the RF region and delivers power at an output section within the interaction region where the amplified RF signal is extracted. After passing through the output section, the beam enters the collector where it is collected and the remaining power is dissipated. The amount of power which needs to be dissipated depends upon the efficiency of the linear beam tube, this being the difference between the power of the beam generated at the electron gun region and the RF power extracted in the output coupling of the RF region. The power that is not recovered as electrical energy in the collector creates heating of the collector electrodes. This heat needs to be removed using a cooling arrangement.

The difference between an IOT and a klystron is that in an IOT, the RF input signal is applied between a cathode and a grid close to the front of the cathode. This causes density modulation of the electron beam. In contrast, a klystron velocity modulates an electron beam, which then enters a drift space in which electrons that have been speeded up catch up with electrons that have been slowed down. The bunches are thus formed in the drift space, rather than in the gun region itself.

In IOTs, klystrons and other linear beam tube types such as TWTs, the efficiency of collection of the electron beam can be improved by using a multi-stage depressed collector. In such an arrangement, there is a plurality of electrically isolated stages of electrodes, each operating at a potential at or between ground and the cathode potential. In one such typical arrangement, a collector has five stages, the difference in potential between the various stages being 25% of the beam voltage. By using such a multi-stage depressed collector, the electrons in the beam are slowed down before impacting on the electrode surfaces, thus leading to greater recovery of energy. Collectors may, of course, have a different number of stages operating at different potentials. The term "depressed" is used in the sense that the voltage at which each electrode is held is "depressed" in relation to ground potential.

In collectors for electron beam tubes, whether klystron, IOT or other, there is a need for an efficient means of extracting and dissipating heat generated by the electron beam striking the electrode(s) of the collector. This requirement exists for both single stage and multi-stage collectors.

Various cooling techniques are known, broadly falling into three categories: air, oil and water-cooled, each having advantages and disadvantages. An example of an oil-cooled collector is known in WO 00/63944. In this arrangement, the electrically conductive electrodes of the collector are formed with channels on their outer surface and are encased by an electrically and thermally non-conductive inner sleeve to define enclosed channels through which oil is pumped as a coolant. The inner sleeve is surrounded by an electrically and thermally conductive (metal) outer sleeve defining a channel, which communicates with channels of the collector electrodes. Cooling is thereby achieved by contact of the coolant fluid with the electrode stages and so, as the electrodes are at different potentials, the coolant (oil) must be an electrical non-conductor.

A second cooling arrangement is known in U.S. Pat. No. 5,493,178. In this arrangement an electrically non-conductive but thermally conductive body surrounds, and is in contact with, the electrodes of the collector. Coolant channels are provided on the exterior of the thermally conductive body and are enclosed by an outer electrically and thermally conductive (metal) casing. The cooling is thus achieved by thermal conduction through the thermally conductive body to the coolant channels containing a cooling fluid. In this arrangement, the coolant fluid is electrically insulated from the electrodes and so the coolant itself could be electrically conductive, such as normal water.

We have appreciated deficiencies in known designs and appreciated the need to provide good thermal conduction from a collector whilst providing a high level of electrical insulation. We have further appreciated the need to provide resilience to expansion and contraction as the collector heats and cools.

The invention is defined in the claims to which reference is now directed. The preferred embodiments of the invention combine the benefits of both oil and water-cooling by providing oil in contact with electrode(s) and a surrounding water-cooling system separated, at least in part, by a plurality of electrically insulative, thermally conductive solid dielectric spacers. Various configurations of the spacers such as in the form of panels are provided, in embodiments of the invention, in thermal contact with the electrode(s), to provide heat transfer to a coolant whilst providing electrical insulation.

Whilst the preferred choice in each of the embodiments is to use oil as the electrically insulative and thermally conductive medium between the solid dielectric spacers, alternatives could include a solid, liquid or gas dielectric. Of importance is that the medium is electrically non-conductive but is thermally conductive and malleable so as to allow movement due to thermal expansion and contraction of the electron beam tube.

BRIEF DESCRIPTION OF THE FIGURES

An embodiment of the invention in the various aspects noted above will now be described with reference to the figures in which.

DESCRIPTION OF A PREFERRED EMBODIMENT

The embodiment of the invention described is an Inductive Output Tube (IOT) with a multi-stage depressed collector. However, it would be appreciated to the skilled person that the collector cooling arrangement described could equally be used with single or multi-stage collectors for other linear beam devices such as travelling wave tubes and klystrons.

Figure 1:
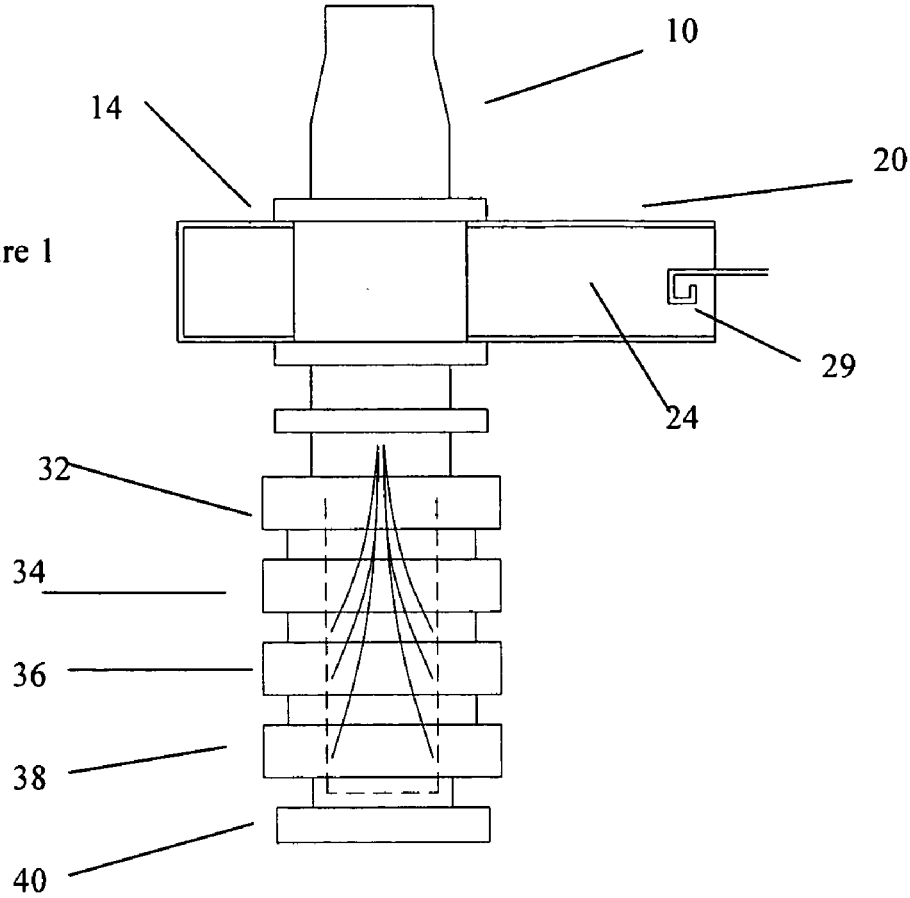
FIG. 1 is a schematic diagram of an IOT and collector to which the invention may be applied.

An IOT embodying the invention is shown in FIG. 1 and comprises an electron gun 10 for generating an electron beam. The electron beam is created from a heated cathode held at a negative beam potential of around −36 kV and accelerated towards and through an aperture in a grounded anode 14 formed as part of a fixed portion of a drift tube 22 described later.

A grid is located close to and in front of the cathode and has a DC bias voltage of around −80 volts relative to the cathode potential applied so that, with no RF drive a current of around 500 mA flows. The grid itself is clamped in place in front of the cathode (supported on a metal cylinder) and isolated from the cathode by a ceramic insulator, which also forms part of the vacuum envelope. The RF input signal is provided on an input transmission line between the cathode and grid. The electron gun 10 is coupled to a drift tube and output section 20 by a metallic pole piece.

The electron beam generated by the electron gun 10, and density modulated by the RF input signal between cathode and grid, is accelerated by the high voltage difference (of the order 30 kV) between the cathode and anode and accelerates into a drift tube 22 of the drift space and output stage 20. The drift tube is defined a first drift tube portion and a second drift tube portion surrounded by an RF cavity defined by an outer wall forming part of the vacuum enclosure with the electron gun and collector assembly. The electron beam passes through a central aperture in the first drift tube portion having a generally disc shaped portion attached to the pole piece and frustoconical section. The drift tube is typically of copper. Connected to the drift tube section is an output cavity 24 containing an output loop 29 via which RF energy in the drift tube section 22 couples and is taken from the IOT.

The electron beam having passed through the drift space and output region 20 still has considerable energy, the full beam voltage being typically 30 kV below ground. It is the purpose of the collector stage 30 to collect this energy, as now described.

The electron beam enters the collector stage 30 from the drift tube. The collector comprises five electrode stages, a first stage 32, a second stage 34, a third stage 36, a fourth stage 38 and a final fifth stage 40. Each electrode in turn is held at a potential "depressed" from the full beam potential ranging from ground to the full beam potential (the full beam potential being cathode potential). The first electrode stage 32 is grounded at anode potential and the final fifth stage 40 is substantially at cathode potential, with the intermediate second, third and fourth electrode stages 34, 36, 38 ranging between these. The metal electrodes are separated from one another by ceramic electrical insulators to hold off the potential difference between successive electrodes. Other numbers of electrodes are possible, for example the first and second electrodes may be both at ground potential and so could effectively be combined as a single electrode giving 4 electrodes. Other numbers such as 3 electrodes are also possible or more.

The electron beam comprises electrons having a range of energies, which need to be collected. Electrons having high energy continue on a nearly straight path and are captured by an electrode stage, which is at a high negative potential. In contrast, electrons having lost the majority of their energy to the RF output signal are repelled by the negative potentials of the second, third, fourth and fifth electrode stages and are deflected onto the first electrode at substantially anode potential. The majority of electrons, however, will have potentials ranging between anode and cathode potentials and so will be captured by the second, third or fourth electrodes which are variously at potentials between anode and cathode, typical paths being shown. Electrons can strike anywhere on the interior surface of the collector 30 that is reachable by a feasible path from the drift tube and this depends upon the physical arrangement of the collector and the voltages applied to the different electrodes.

The electrons striking the electrode surfaces cause heating and, for this reason, a cooling arrangement is provided around the outside of the collector to allow a liquid coolant to be circulated, thereby enabling extraction of heat from the collector.

Figure 2:
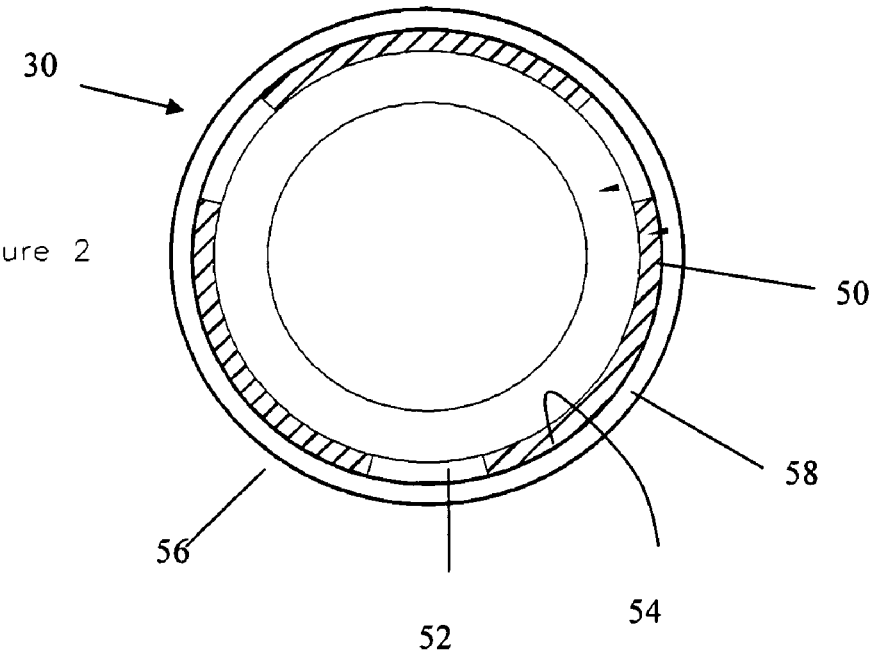
FIG. 2 is a radial cross-sectional view of a collector cooling arrangement according to a first embodiment of the invention.

A first cooling arrangement is shown in FIG. 2. In this arrangement a thermally conductive but electrically non-conductive spacer arrangement of spacers 50 that are electrical insulators are arranged circumferentially around the longitudinal axis of the collector 30. The electrical insulator spacers in the form of panels 50 are in good thermal contact with the exterior of the metal electrodes of the collector stage. The preferred choice of electrical insulation is ceramic, in the form of panels extending in the longitudinal direction of the collector. In between the panels 50, gaps 52 between the ceramic electrode spacers 60 and the inner wall 54 of a water cooling system are filled with oil held in place by an inner wall 54 of a water cooling system, typically of metal or other thermally conductive material. Heat generated by the electrodes is conducted by the spacer panels 50 and the oil in channels 52 to the metal (and, therefore, thermally conductive) inner wall 54. To remove the heat, water is pumped through a gap 58 between the inner wall 54 and an outer wall 56.

Figure 3:
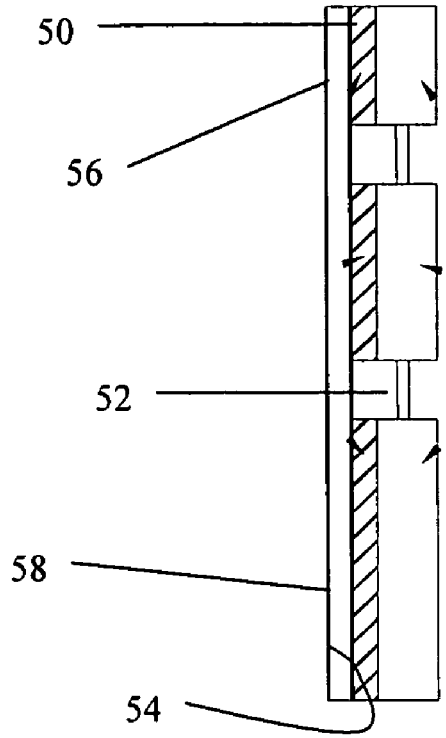
FIG. 3 is a longitudinal cross-sectional view of the collector cooling arrangement of FIG. 2.

The first cooling arrangement is shown in longitudinal cross section in FIG. 3. The ceramic spacer 50 in thermal contact with the electrode stages 30 conducts heat to the inner wall 54 for dissipation through the pumped coolant, in this case water, in the gap between inner wall 54 and outer wall 56.

The arrangement of FIGS. 2 and 3 has a number of advantages. Oil as a coolant medium is known, but has a risk of fire in the event of a fault in the coolant system. Surrounding the oil with a water coolant layer reduces the risk. The use of separate distributed ceramic spacers 50 reduces the stress on the ceramic due to thermal expansion in comparison to using larger ceramic components. The oil filling gaps between the ceramic spacers ensures good voltage hold off between the electrodes and the inner wall. Furthermore, any failure in the ceramic components by cracking or breaking will automatically be compensated by oil flowing into the crack preventing arcing, which could otherwise occur. The inner wall 54 is electrically insulated by the ceramic and oil from the electrodes and so any general coolant such as normal tap water can be used to remove heat from the inner wall.

The embodiment provides a hybrid of oil and water cooling systems not previously attempted. By surrounding the metal surface of the collector with an electrically non-conductive liquid such as oil, good heat transfer is provided even though the oil itself is not pumped. It is advantageous that the oil does not need to be pumped as it is a difficult an energy in efficient medium to pump in a cooling system. It is particularly advantageous that the oil is provided in the channels 52 between collectors to ensure voltage holdoff. The ceramic spacers provide good thermal conduction and provide a supporting structure to hold the water cooling system away from the electrodes. The oil can seep into any gaps or cracks between the ceramic panels to ensure the oil and panels together provide a continuous electrical insulator around the collector.

The water cooling system around the ceramic spacers is electrically isolated from the collectors and so can use normal water (in contrast to de-ionised water as typically required by water cooling systems in which the water is not electrically separated from the electrodes). This is a significant advantage as the cost of providing the coolant is thus much reduced.

The ceramic spacers themselves are preferably bonded to the surface of the collector by a metal loaded paste. This ensures good thermal conduction and also prevents any dielectric charging due to any air gap that otherwise could exist.

Figure 4:
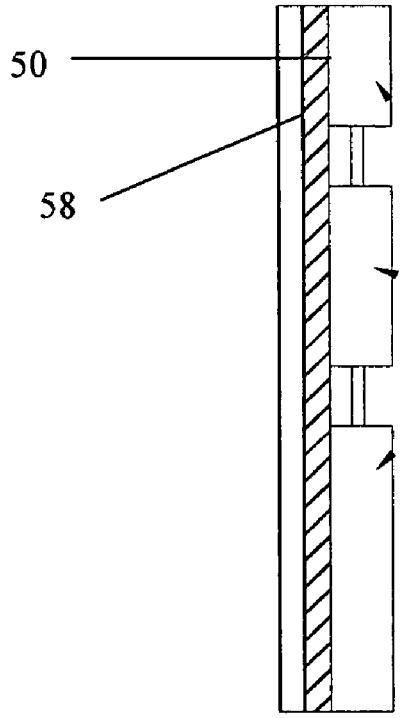
FIG. 4 is a longitudinal cross-section of a second embodiment of the invention.

A second embodiment is shown in FIG. 4. In this embodiment, the ceramic spacer arrangement and water coolant between inner and outer walls is arranged as a "jacket" to cover each electrode stage. The electrical insulative panels in this embodiment are along the entire length of the collector.

The second embodiment provides simplicity of construction and the ability to retain the oil which surrounds the collector within the dielectric panels. In a sense, the collector is bathed in oil retained by the dielectric panels.

Figure 5:
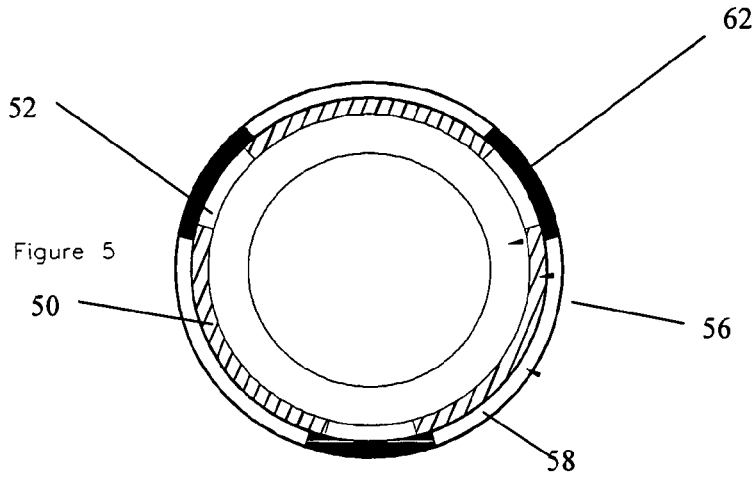
FIG. 5 shows a third embodiment of the invention incorporating the features of the first embodiment with additional separator components.

A third embodiment is shown in FIG. 5, showing a radial section of the collector cooling arrangement. Ceramic spacers 50 in the form of generally flat longitudinal panels are arranged circumferentially around the electrode stage 30 as with FIG. 3. The addition in this embodiment is a separator 62 arranged adjacent the oil channels 52 and extending between water channels 58. The ceramic spacers 50 are heated by the electrode stages directly and conduct this heat to the inner wall 54 as previously described. The additional separators 60 thus ensure the cooling water is focused where it is most effective, namely adjacent the electrically insulative panels 50.

Figure 6:
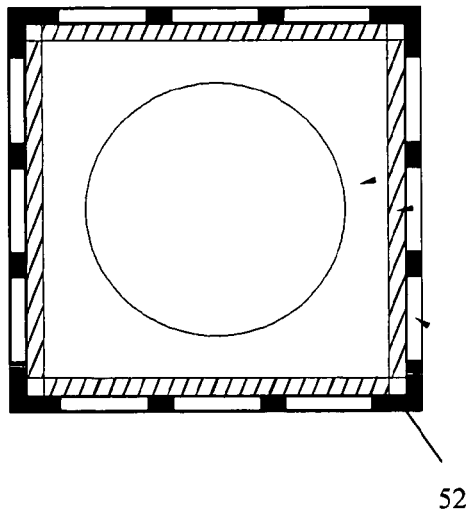
FIG. 6 shows a fourth embodiment of the invention similar to the third embodiment but having a square external cross section.

A fourth embodiment shown in FIG. 6 uses the same principles as already described but has a square exterior cross section shaped collector electrode. This allows the exterior surface to have large flat areas improving thermal conduction. Also, the ceramic spacers 50 can be manufactured as large flat plates. Oil is also provided in channels 52 between panels as before.

Figure 7:
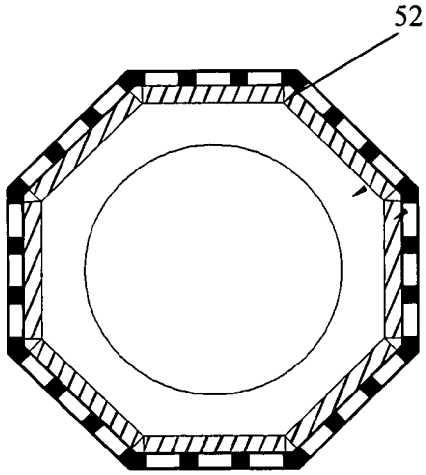
FIG. 7 shows a fifth embodiment of the invention similar to the third but having an exterior octagonal cross section.

A fifth embodiment is shown in FIG. 7 also using the same principles, but having an octagonal external cross section.

In either of the fourth and fifth embodiments, the electrode itself may be machined to have the exterior cross section presented or may be formed by an additional outer casing.

Figure 8:
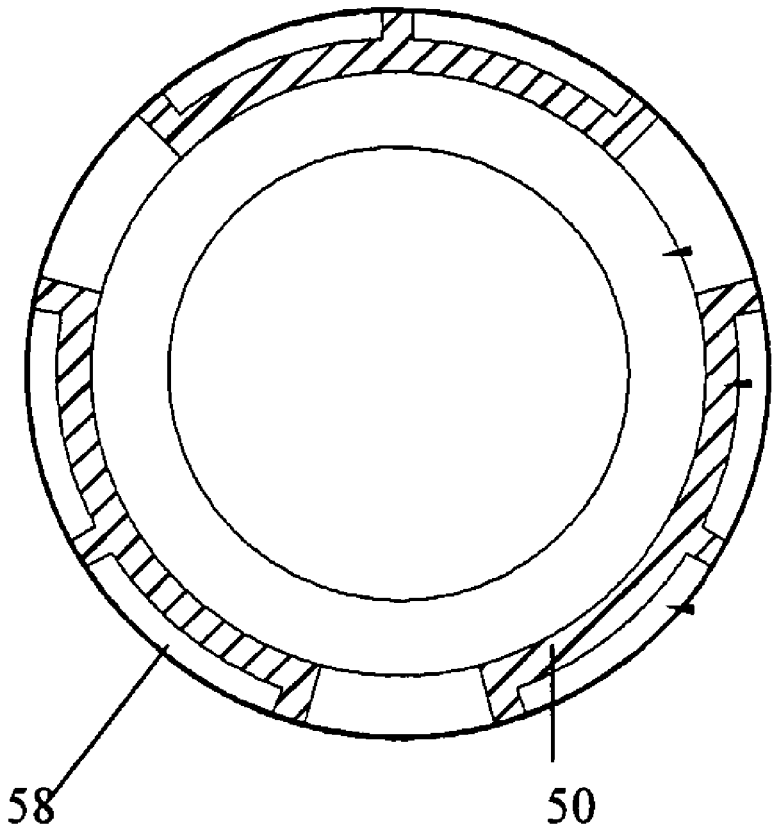
FIG. 8 shows a sixth embodiment of the invention in which the electrically insulative panels bound the fluid flow.

A sixth embodiment shown in FIG. 8 uses the same principles as the embodiments already described. Additionally, the electrically insulative panels 50 are so shaped as to define a set of channels 58 rather than an annular space for coolant water or requiring additional separators.

In all the embodiments, the cooling system advantageously can use "dirty" water (in the sense that plain, rather than de-ionised, water can be used). Good thermal conduction is maintained by "bathing" the collector in oil. The solid dielectric spacers provide a support for the cooling jacket and also provide good heat transfer. The use of multiple spacers, rather than a single block, means that movement is allowed between the collector and spacers, and between the spacers and the water cooling jacket. This allows differential expansion of these components.

The ceramic spacers can be any suitable shape such as panels, blocks or rods. In the case of rods, these could be spaced around the circumference of the collector.

The ceramic used for the spacers is preferably alumina of 94% purity of thickness 3 mm-6 mm. Alternatives include, aluminium nitride, beryllia and boron nitride. The water jacket is preferably stainless steel of thickness around 10 mm.

Although it is an advantage that the oil does not need to be pumped, in each of the embodiments described an alternative embodiment could use a pump system to circulate the oil.

Whilst the preferred choice in each of the embodiments is to use oil as the electrically insulative and thermally conductive medium between the solid dielectric spacers, alternatives could include a solid, liquid or gas dielectric. Of importance is that the medium is electrically non-conductive but is thermally conductive and malleable so as to allow movement due to thermal expansion and contraction of the electron beam tube. Alternative dielectrics include: room temperature vulcanisation silicone rubber, such as Sylgard, a SF6 gas, such as hexafluoride, or a CFC, such as Freon.

The invention claimed is:

1. An arrangement for cooling an electron collector of an electron beam tube, comprising a plurality of solid dielectric spacers that are electrically insulative and thermally conductive arranged in thermal contact with an exterior surface of the collector, an electrically insulative and thermally conductive dielectric arranged in gaps between the solid dielectric spacers and in contact with the collector, and a water cooling system arranged so as to be in thermal contact with and electrically separated from the exterior surface of the collector by the plurality of spacers and the electrically insulative and thermally conductive dielectric so as to provide cooling by water circulation.

2. An arrangement according to claim 1, wherein the spacers are arranged to extend along the length of the collector.

3. An arrangement according to claim 1, wherein the spacers are arranged intermittently along the length of the collector.

4. An arrangement according to claim 1, wherein the spacers are in the form of panels and are arranged such that each panel covers a portion of exterior surface around the outside of the collector.

5. An arrangement according to claim 1, wherein the water channels are arranged only at locations of the spacers.

6. An arrangement according to claim 1, wherein the water channels comprise channels within the panels.

7. An arrangement according to claim 1, further comprising one or more oil channels arranged in gaps between the spacers.

8. An arrangement according to claim 4, wherein the exterior surface of the collector is substantially cylindrical and each panel is curved so as to fit against part of the exterior surface.

9. An arrangement according to claim 4, wherein the exterior surface of the collector includes a plurality of flat portions, the panels being arranged at the flat portions.

10. An arrangement according to claim 4, wherein the exterior surface of the collector includes a plurality of flat portions, the panels being arranged at the flat portions and the exterior surface of the collector is of substantially square cross section.

11. An arrangement according to claim 4, wherein the exterior surface of the collector includes a plurality of flat portions, the panels being arranged at the flat portions and the exterior surface of the collector is of substantially octagonal cross section.

12. An arrangement according to claim 1, wherein the electrically insulative and thermally conductive dielectric is a liquid.

13. An arrangement according to claim 1, wherein the electrically insulative and thermally conductive dielectric is oil.

14. An arrangement according to claim 1, wherein the electrically insulative and thermally conductive dielectric is silicone rubber.

15. An arrangement according to claim 1, wherein the electrically insulative and thermally conductive dielectric is a gas.

16. An arrangement according to claim 1, wherein the electrically insulative and thermally conductive dielectric is a chlorofluorocarbon.

17. An arrangement according to claim 1, wherein solid dielectric spacers are of alumina.

18. An arrangement according to claim 1, wherein solid dielectric spacers are of aluminium nitride.

19. An arrangement according to claim 1, wherein solid dielectric spacers are of beryllia.

20. An arrangement according to claim 1, wherein solid dielectric spacers are of boron nitride.

21. An arrangement according to claim 1, wherein the arrangement is for cooling a multi-stage collector and the electrically insulative and thermally conductive dielectric is arranged in gaps defined by space between successive electrodes and between the electrodes and the spacers.

22. An arrangement according claim 1, wherein the electrically insulative and thermally conductive dielectric is a liquid which is not pumped.

* * * * *

UNITED STATES PATENT AND TRADEMARK OFFICE

CERTIFICATE OF CORRECTION

PATENT NO. : 7,586,264 B2
APPLICATION NO. : 11/489712
DATED : September 8, 2009
INVENTOR(S) : Stokes et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 653 days.

Signed and Sealed this

Fourteenth Day of September, 2010

David J. Kappos

David J. Kappos
*Director of the United States Patent and Trademark Office*